US006086176A

United States Patent [19]

Aoyama

[11] Patent Number: 6,086,176

[45] Date of Patent: Jul. 11, 2000

[54] CABINET

[75] Inventor: Masataka Aoyama, Kumamoto, Japan

[73] Assignee: Kyoyei Kikaku Inc., Kumamoto, Japan

[21] Appl. No.: 09/217,206

[22] Filed: Dec. 22, 1998

[30] Foreign Application Priority Data

Dec. 25, 1997 [JP] Japan ..... 9-356880
Nov. 10, 1998 [JP] Japan ..... 10-318639

[51] Int. Cl.[7] ..... A47B 81/00

[52] U.S. Cl. ..... 312/286; 312/301; 312/319.1

[58] Field of Search ..... 312/319.1, 285, 312/286, 287, 333, 301, 308; 292/251.5

[56] References Cited

U.S. PATENT DOCUMENTS 4,912,727 3/1990 Schubert ..... 292/251.5

FOREIGN PATENT DOCUMENTS 625845 8/1927 France ..... 312/285

*Primary Examiner*—Peter M. Cuomo
*Assistant Examiner*—Jerry Anderson
*Attorney, Agent, or Firm*—Wenderoth, Lind & Ponack, L.L.P.

[57] ABSTRACT

In a cabinet of a type in which drawers received in a box-shaped case can be pulled out through both end openings of the case, an arrangement is provided which makes it possible to retain each drawer in a position in which it is neatly received in the case. The case has a drawer receiving space having openings at both ends of the case. The drawer received in the drawer receiving space is supported so as to be slidable outwardly through either end opening. A positioning device is provided between the underside of the drawer and the opposing surface of a drawer support member so as to retain the drawer when pushed into the drawer receiving space so that the cabinet always looks in order.

7 Claims, 11 Drawing Sheets

CABINET

BACKGROUND OF THE INVENTION

This invention relates to a cabinet having a box shaped case in which are received drawers which can be pulled out at least in forward and backward directions.

Side cabinets used in hospitals and desk workers' cabinets have a box-shaped case in which are received drawers which can be pulled out through two opposite ends of the case.

A two-way draw cabinet can be placed in any position provided its drawers can be pulled out through two end openings, and thus is convenient to use.

Conventional two-way draw cabinets have no positioning means for retaining the drawers in a position in the respective drawer receiving spaces in the case. Thus, a user may push in a drawer or two too deep into the case, in which case, the drawers+ end, which are remote from the user, protrude from the case, or a user may not push in a drawer or two deep enough into the case, in which case, the drawer's ends near the user protrude from the case. In either case, the cabinet looks messy.

An object of this invention is to provide a cabinet having a drawer which is received in a box-shaped case, and which can be pulled out from both ends of the case and pushed back into the case accurately to a predetermined position so that the cabinet always looks in order and is easy to use.

SUMMARY OF THE INVENTION

According to this invention, there is provided a cabinet comprising a box-shaped case having a drawer receiving space and end openings on front and back ends of the case. A drawer is slidably received in the drawer receiving space so as to be pulled out of the drawer receiving space through either of the openings. Also, a positioning means is provided for positioning and retaining the drawer in a position where the drawer is completely inserted in the space.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
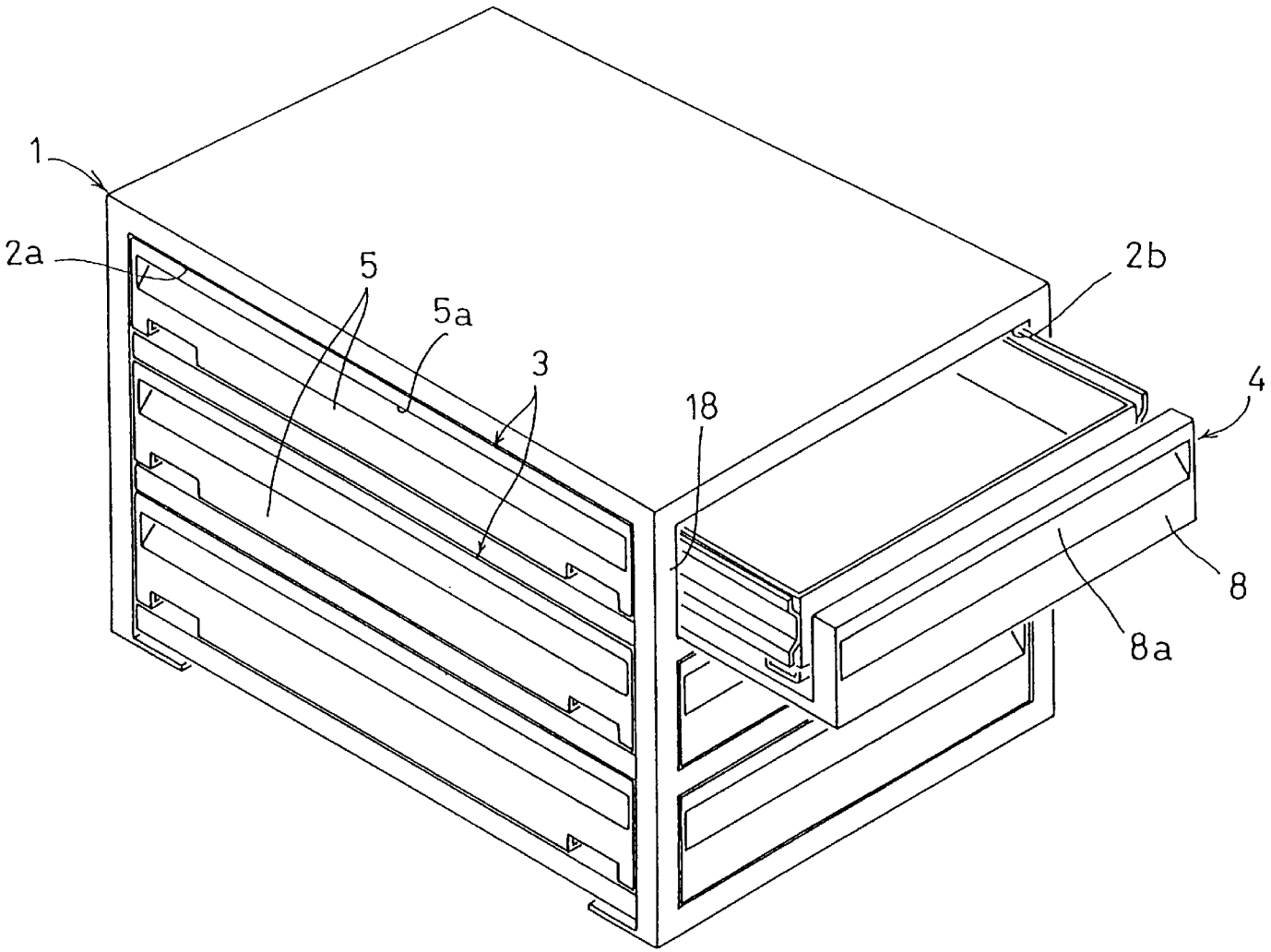
FIG. 1 is a perspective view of a cabinet embodying this invention.
Figure 2:
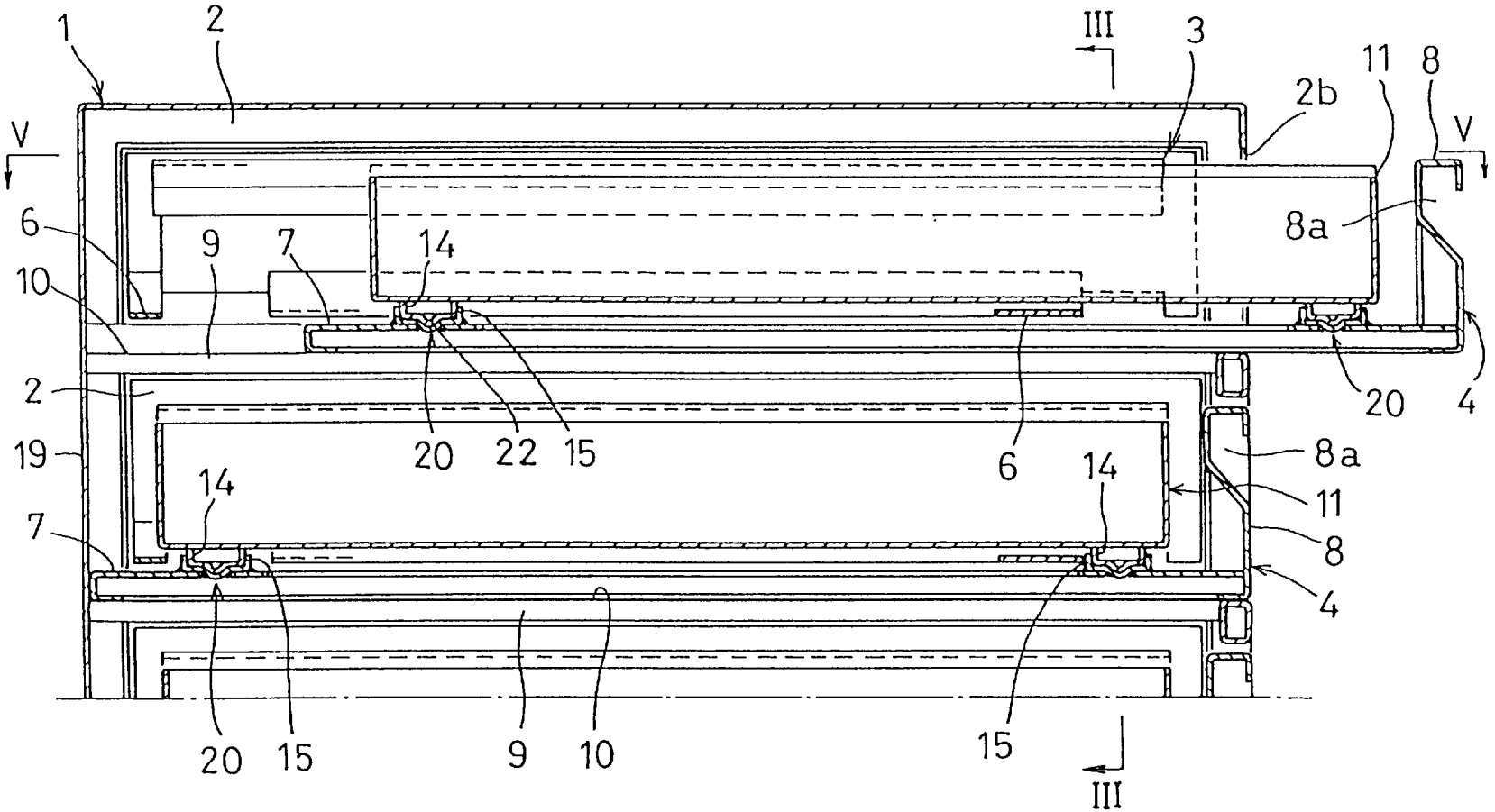
FIG. 2 is a side view in vertical section of the cabinet shown in FIG. 1.

Embodiments of this invention are described below with reference to the drawings.

(First Embodiment)

As shown in FIGS. 1–4, a box-shaped case 1 is formed with a plurality of drawer receiving spaces 2 arranged one over another and having openings at both ends and on one side of the case 1.

A drawer support frame 3 and a frame support slide frame 4, in which the support frame 3 is received, are inserted in each drawer receiving space 2. Each drawer support frame 3 comprises a pair of end panels 5 insertable into the space 2 through either end opening 2*a*, and bridges 6 connecting both ends of the panels 5 at their bottoms. The frames 3 can be pulled out of the respective spaces 2 through either end opening 2*a* by engaging a finger in a pull 5*a* formed on each panel 5.

Figure 3:
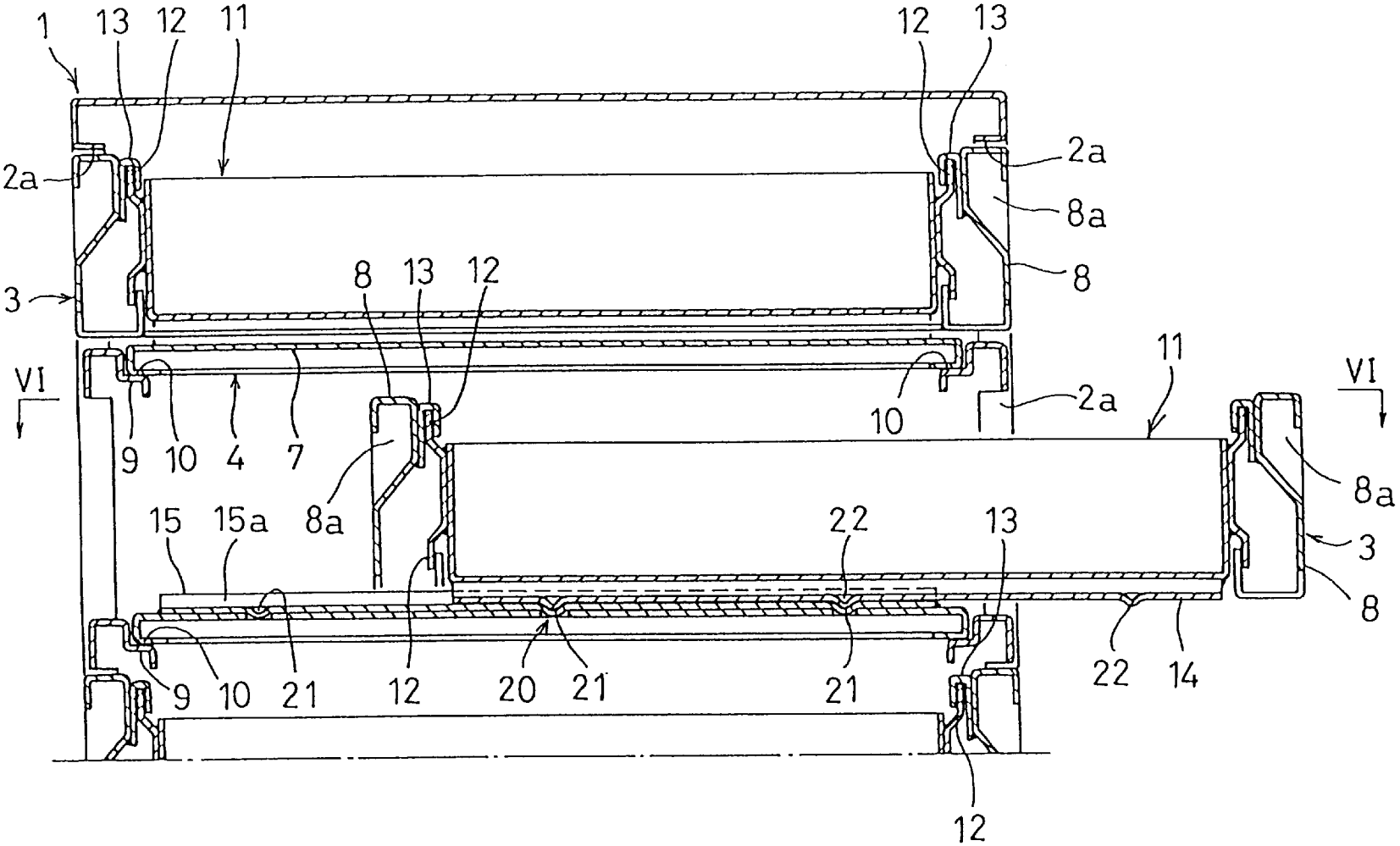
FIG. 3 is a sectional view taken along line III—III of FIG. 2.

Each slide frame 4 comprises a slide plate 7 and a side panel 8 provided along one side edge of the slide plate 7, and the slide frame is insertable into each space 2 through side opening 2*b*. In each space 2, the slide plate 7 has its portions near both ends slidably supported by guide ribs 10 formed on a bottom plate 9 (FIG. 3). Thus, each of the slide plates 7 can be pulled out of the respective space 2 through the side opening 2*b* along the guide ribs 10 by engaging fingers in a pull 8*a* formed on the side panel 8.

The drawer support frame 3 supports a drawer 11 between the pair of end panels 5. The drawer 11 has a pair of lateral guide plates 12 laterally slidably supported by first rails 13 provided on the backsides of the end panels 5 of the drawer support frame 3.

Figure 4:
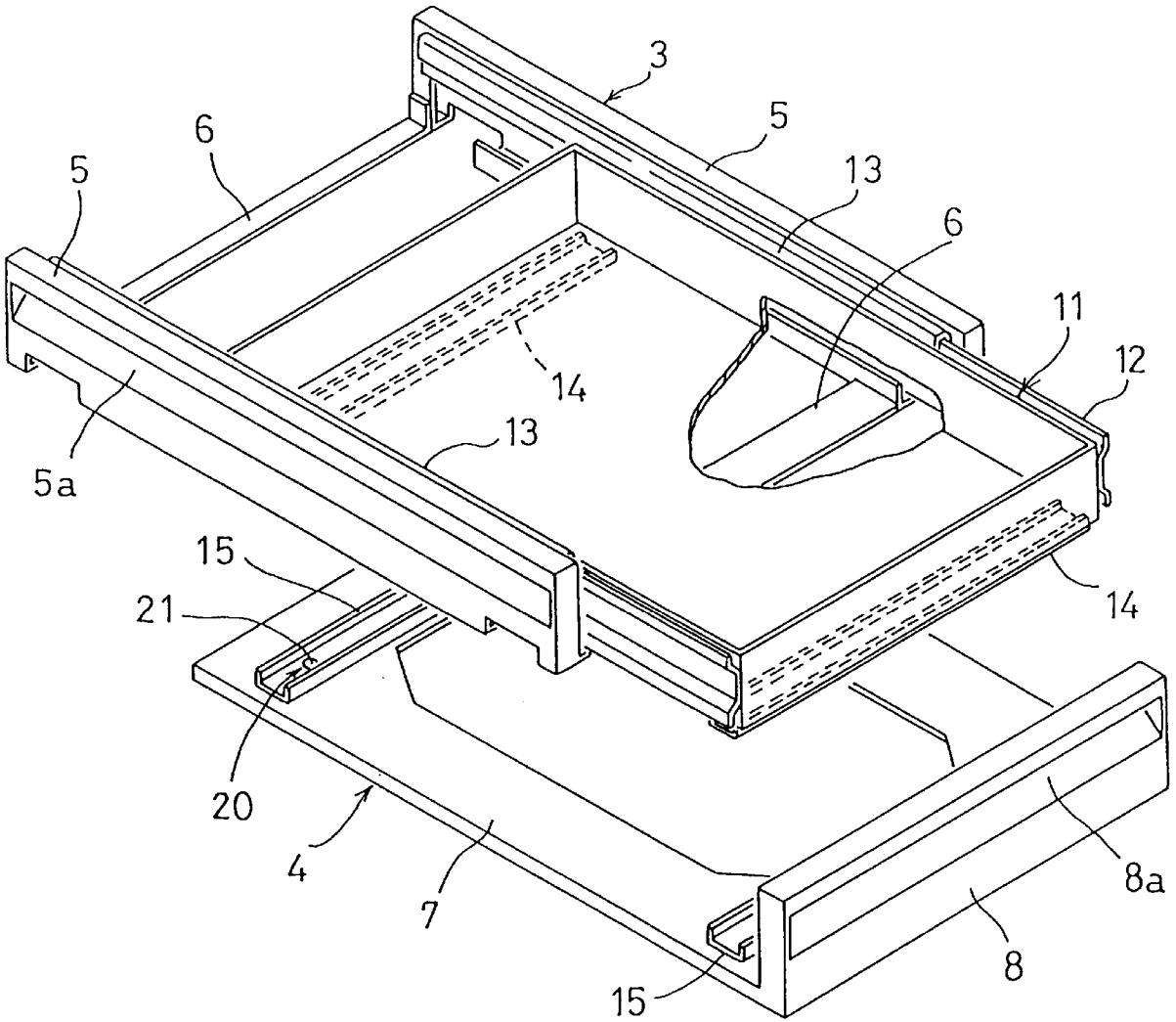
FIG. 4 is an exploded perspective view of the cabinet shown in FIG. 1.
Figure 5:
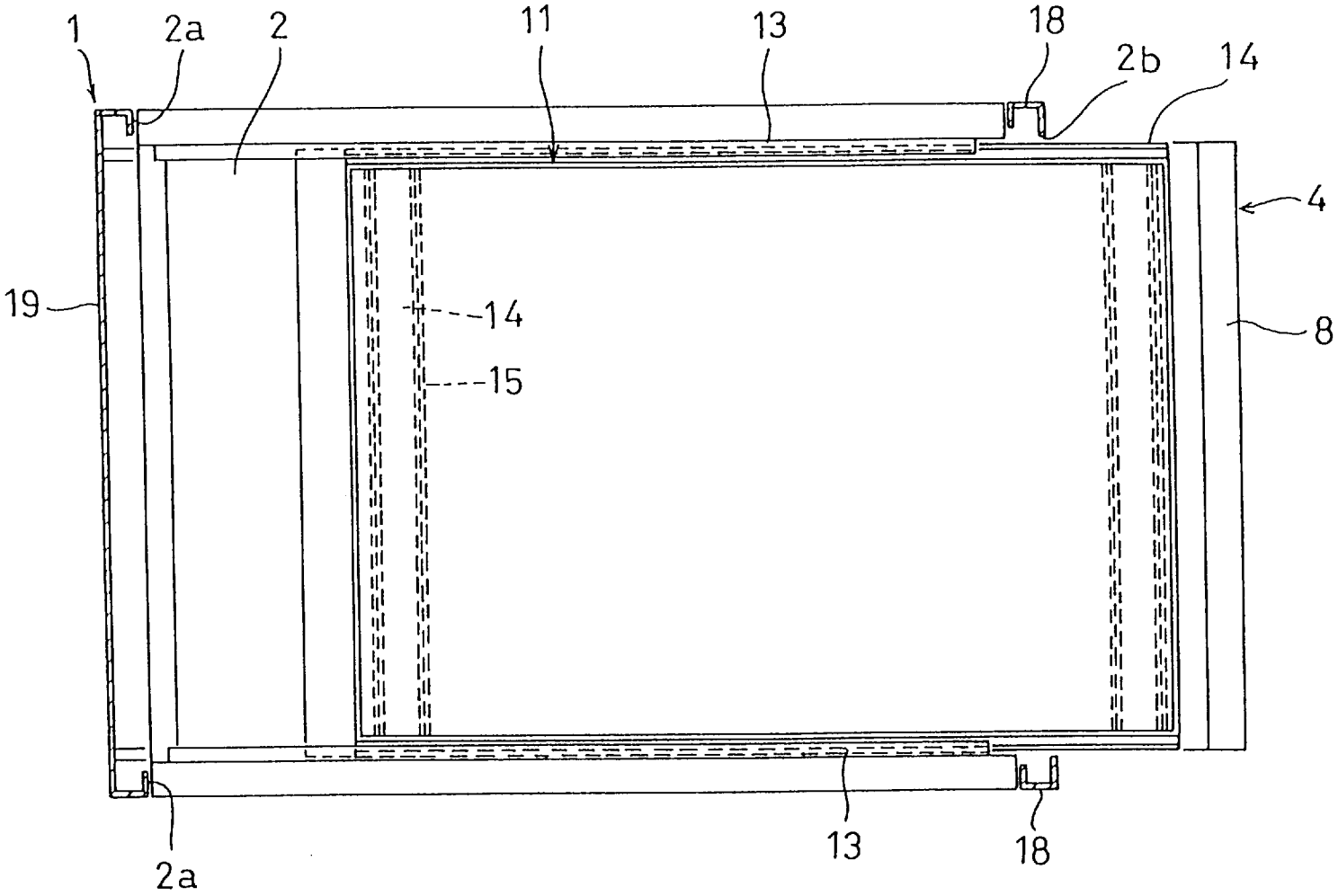
FIG. 5 is a sectional view taken along line V—V of FIG. 2.
Figure 6:
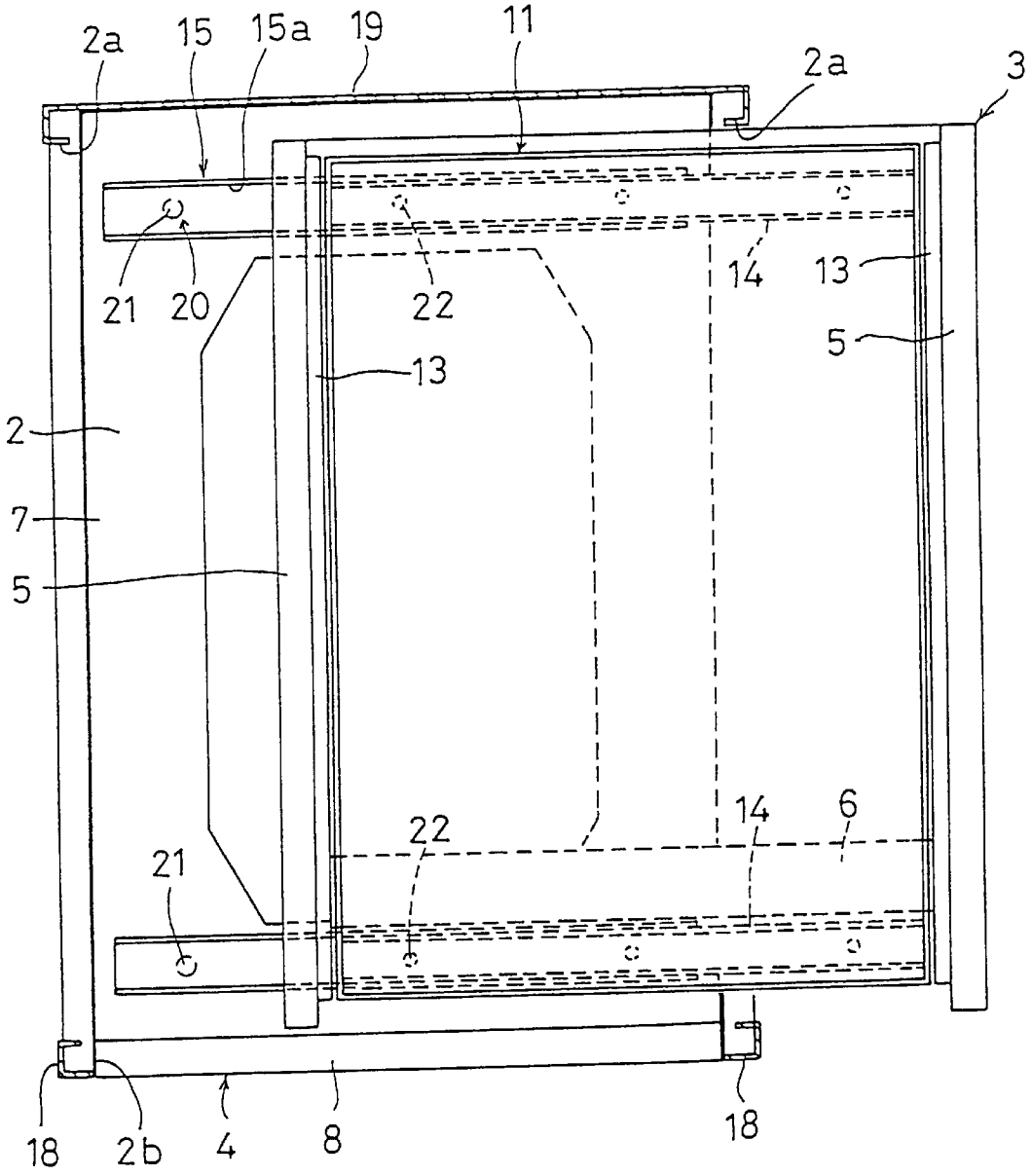
FIG. 6 is a sectional view taken along line VI—VI of FIG. 3.
Figure 7:
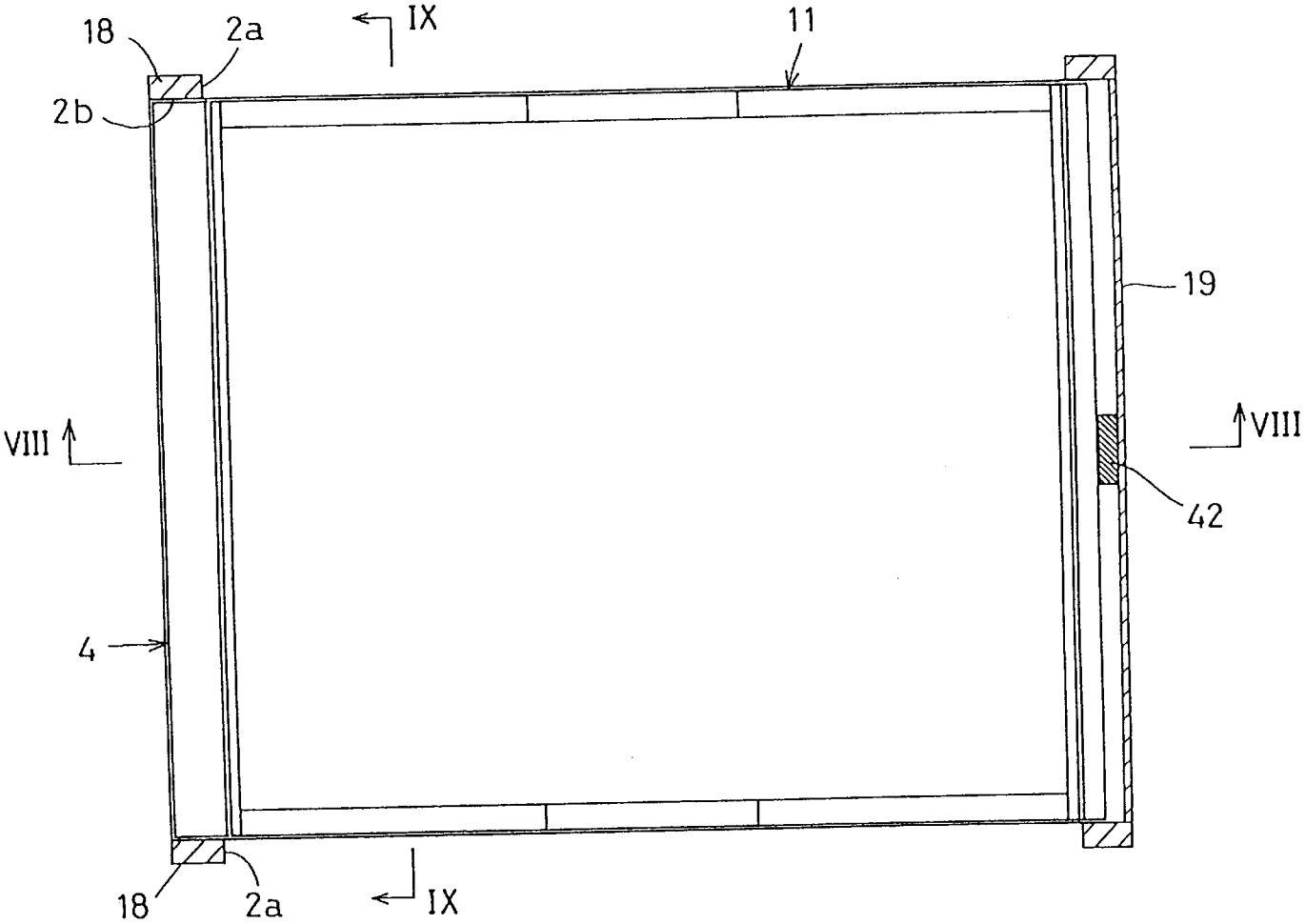
FIG. 7 is a horizontal sectional view of another cabinet embodying this invention.

The drawer 11 has a pair of bars 14 provided on the underside of its bottom plate near both sides to extend substantially the entire length thereof. The bars 14 are slidably received in guide grooves 15*a* of second rails 15 provided on the slide plate 7 of the slide frame 4. (FIG. 4)

Positioning means 20 are provided on the opposed surfaces of the second rails 15 and the drawer 11 to retain the drawer 11 in position with the drawer 11 completely received in the respective drawer-receiving space 2. The positioning means 20 comprises a plurality of recesses 21 provided on the bottom of the guide groove 15*a* of each second rail 15, and a plurality of semispherical protrusions 22 provided on the underside of each bar 14. When the drawer is completely inserted in the space 2, the protrusions 22 engage in the recesses 21, so as to retain the drawer 11 in position.

When the drawer support frame 3 is pulled out by engaging a finger or two in the pull 5*a* of one of the panels 5, the drawer 11 can be pulled out together with the drawer support frame 3 along the guide grooves 15*a* of the second rails 15, while the protrusions 22 are moved out of the recesses 21 and slide along the guide grooves 15*a*.

When the drawer 11 is pulled out to the position shown in FIG. 3, one protrusion 22 engages in a recess 21, thus temporarily retaining the drawer in position.

When the drawer support frame 3 is pushed in, the drawer 11 is pushed into the space 2 together with the drawer support frame 3. When the drawer support frame 3 is completely inserted in the space 2, the protrusions 22 engage in the respective recesses 21, thereby accurately retaining the drawer in position in the space 2.

On the other hand, when the slide frame 4 is pulled by engaging a finger or two in the pull 8*a* of its panel 8, the slide frame 4 can be pulled out, guided by the ribs 10.

At this time, since the bars 14 provided on the underside of the drawer 11 are received in the guide grooves 15*a* of the second rails 15 of the slide frame 4, the drawer 11 is pulled out together with the slide frame 4.

When the slide frame 4 is pulled out in this way, if the drawer 11 has not been inserted completely in the space 2, it is impossible to pull out the slide frame 4 because one corner of the drawer 11 interferes with one of the corner posts 18 of the case 1 defining its side opening 2*b*. If this happens, the drawer support frame 3 has to be pushed in until the frame 3 is completely received in the space 2, and then the frame 4 has to be pulled out once again.

However, when the drawer 11 is inserted into the space 2 by pushing in the drawer support frame 3, the drawer 11 can be held in the position where it is completely inserted in the space by the engagement of the protrusions 22 in the recesses 21. Thus, the slide frame 4 can be smoothly pulled out together with the drawer 11 without the possibility of a corner of the drawer 11 interfering with one of the corner posts 18 of the case.

The drawer 11 can thus be pushed in and pulled out smoothly and easily without the need of repeatedly pushing in and pulling out the drawer support frame 3.

The slide frame 4 can be inserted completely into the space 2 together with the drawer 11 simply by pushing it in until it abuts the back plate 19 of the case 1. Thus, the drawer support frame 3 can be smoothly pulled out through either end opening 2*a* without the possibility of one corner of the drawer 11 interfering with the corner post 18.

(Second Embodiment)

FIGS. 7 to 10 show another cabinet embodying this invention. The cabinet of this embodiment has no drawer support frame 3 as in the first embodiment shown in FIGS. 1 to 4. The drawer 11 has bars 14*a* provided on the underside thereof on both sides and received in guide grooves 15*a* formed in the top surface of the slide plate 7 of the slide frame 4 on both sides thereof so as to be slidable along the grooves 15*a*.

The slide plate 7 of the slide frame 4 has a pair of ribs 30 provided on its underside near both ends and extending the entire width thereof. The ribs 30 are received in guide grooves 31 formed in the bottom plate 9 near both ends and extending the entire width thereof to slidably support the slide frame 4.

The drawer 11 is held in position by a positioning means 20 comprising permanent magnets 23*a*, 23*b* of different polarity. The permanent magnet 23*a* is embedded in the underside of the drawer 11, while the permanent magnet 23*b* is embedded in the top surface of the slide plate 7 of the slide frame 4.

Figure 8:
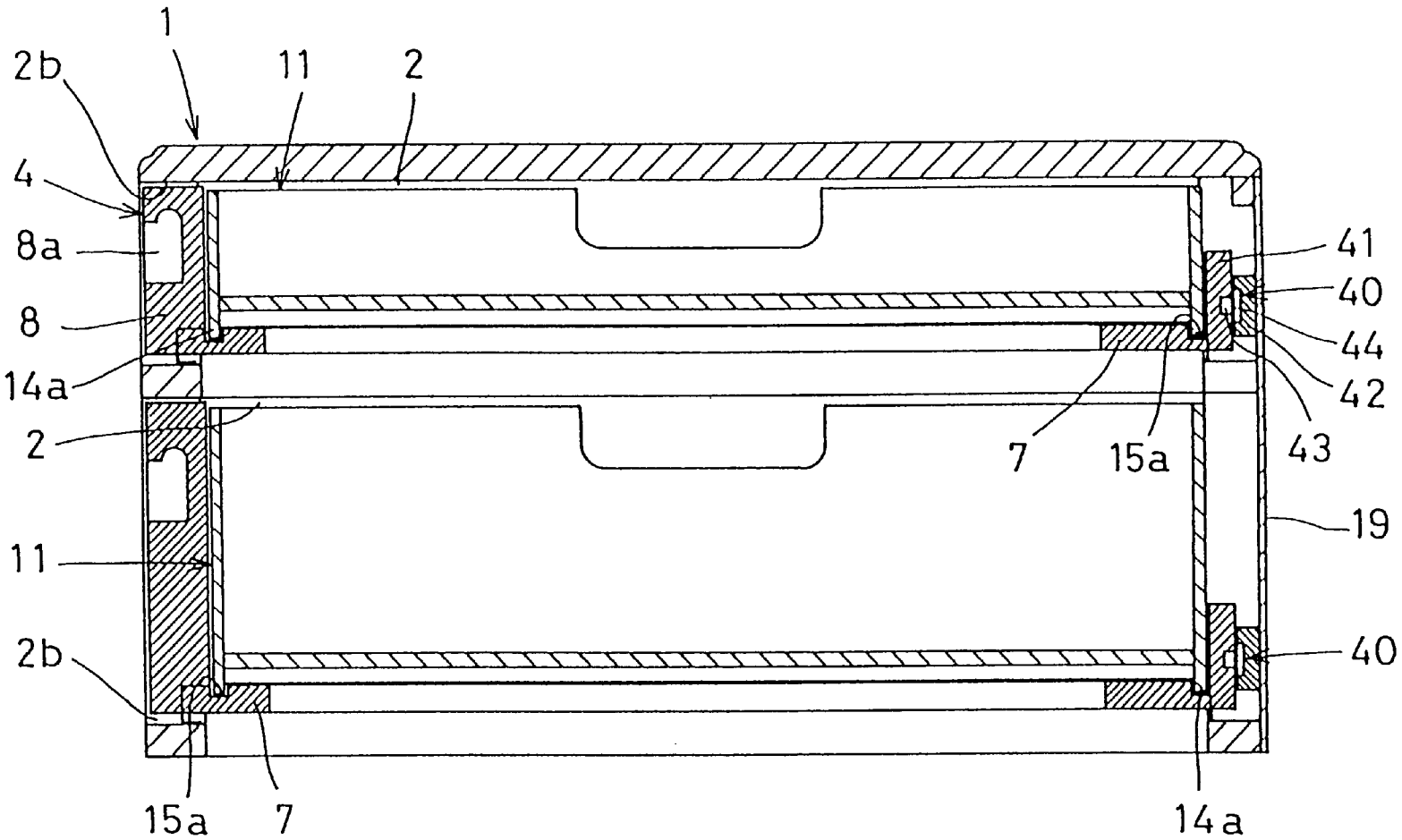
FIG. 8 is a sectional view taken along line VIII—VIII of FIG. 7.
Figure 9:
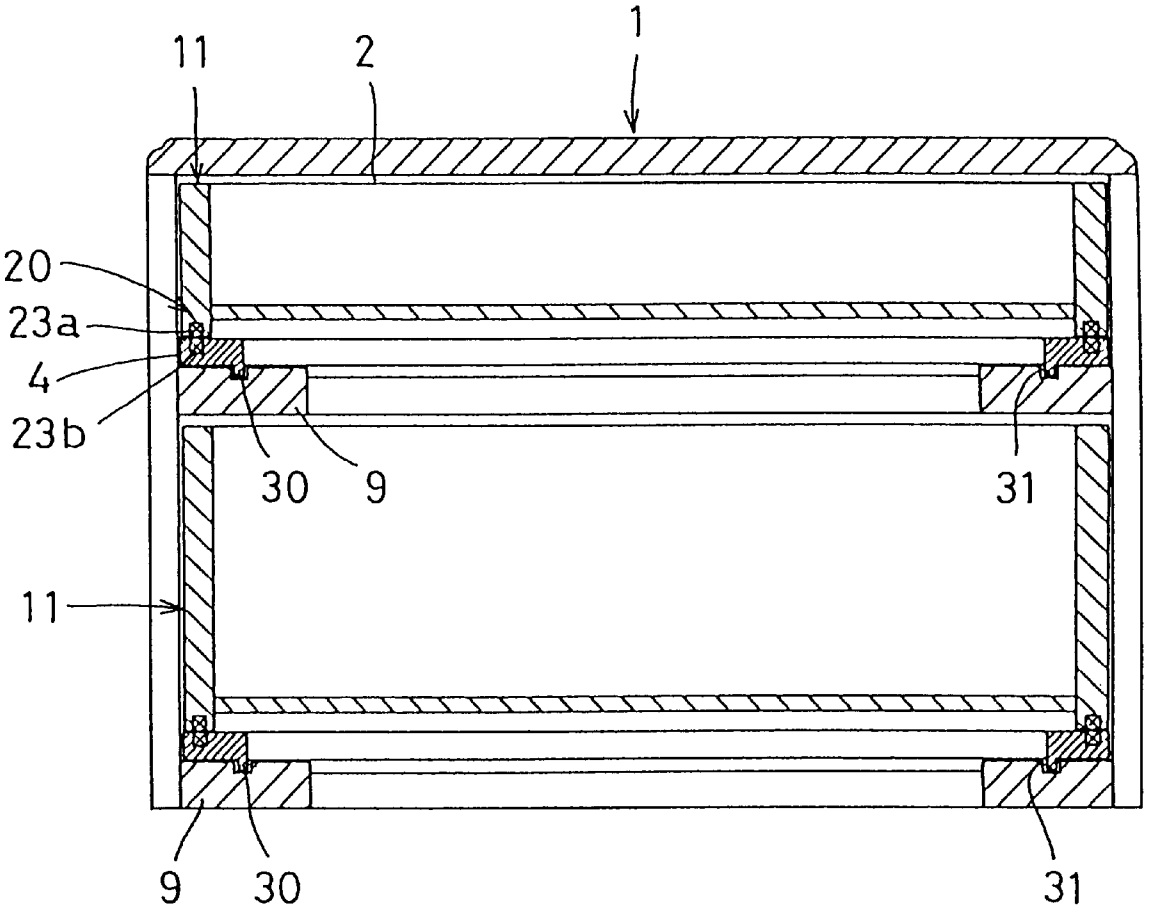
FIG. 9 is a sectional view taken along line IX—IX of FIG. 7.
Figure 10:
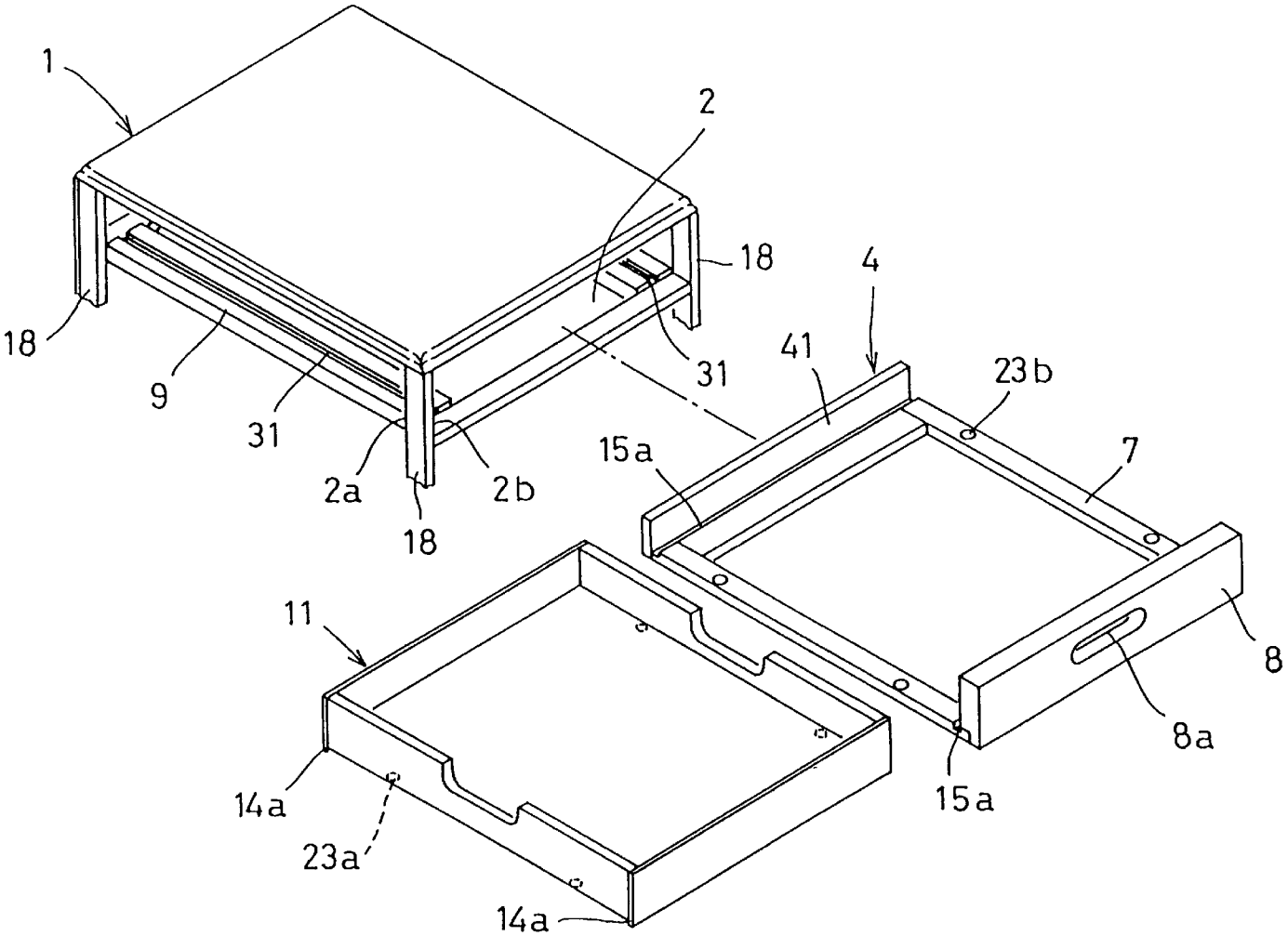
FIG. 10 is an exploded perspective view of the cabinet shown in FIG. 7.

To retain the slide frame 4 in position in the space 2, a second positioning means 40 is provided between the drawer 11 and the case 1 (FIG. 8). The second positioning means 40 has a positioning plate 41 provided on the other side of the slide frame 4. The positioning plate 41 abuts a protrusion 42 formed on the inner surface of the back plate 19 of the case 1. At this position, a metallic piece 44 embedded in the protrusion 42 is magnetically attracted to a permanent magnet 43 embedded in the positioning plate 41, thus retaining the frame 4 in position.

In this embodiment, when the drawer 11 is pushed into the space 2, the permanent magnets 23*a* and 23*b* that differ in polarity are magnetically attracted toward each other, thus retaining the drawer 11 in position. Thus, it is possible to smoothly pull out the drawer 11 together with the slide frame 4 without the possibility of one corner of the drawer inteferring with the corner post 18.

Figure 11A:
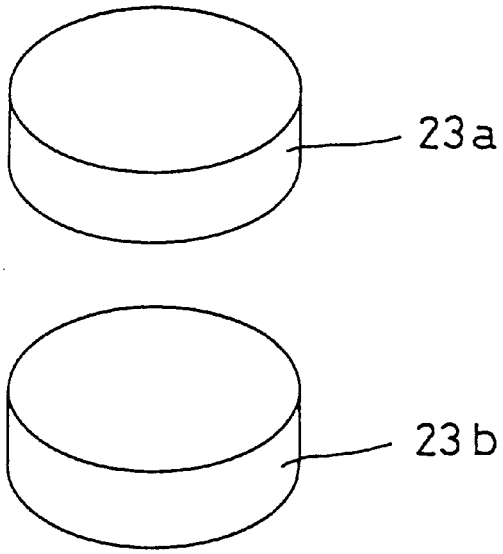
FIGS. 11A and 11B are exploded perspective views of permanent magnets employed in the cabinet shown in FIG. 7 thereof.
Figure 11B:
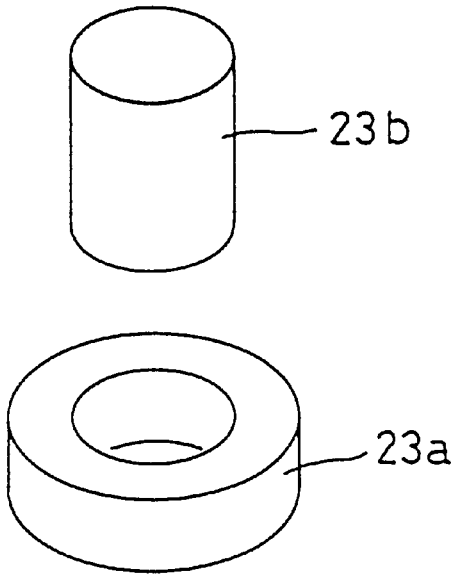

The permanent magnets 23*a*, 23*b* may be circular ones having the same diameter as shown in FIG. 11A. In another possible arrangement, shown in FIG. 11B, the permanent magnet 23*a* is a ring, while the permanent magnet 23*b* is a pin having substantially the same diameter as the internal diameter of the ring magnet 23*a*. In this arrangement, the magnets are coaxial with each other when they are magnetically coupled together, so that it is possible to retain the drawer 11 in position with an extremely high degree of accuracy.

The cabinets of both embodiments have openings on three sides, but the present invention is not limited to this type of cabinet.

For example, the present invention is applicable to a cabinet having only end openings so that the drawer can be pulled out back and forth only. In this case, the drawer support frame 3 and the slide frame 4 shown in FIG. 4 are not needed. In this arrangement, positioning means 20 are provided on the opposed parts of the underside of the drawer 11 and the bottom plate 9.

Also, the present invention encompasses a cabinet having openings on all four sides of the case so that the slide frame 4 can be pulled out through either one of the side openings. The drawer 11 can be pulled out through any of the four openings.

In this case, positioning means for the slide frame 4 are provided between the underside of the slide frame 4 and the top of the bottom plate 9.

As described above, according to this invention, by pushing the drawer into the drawer receiving space of the case through one of its end openings, the drawer is positioned by the positioning means, so that the cabinet always has a neat appearance.

The slide plate is supported so as to be slidable outwardly through a side opening formed in the case. Thus, the drawer can be pulled out in three directions through the end openings and one side opening, so that the cabinet can be placed relatively freely and thus are convenient to use. Since each of the drawer and the slide frame can be held in a predetermined position in the drawer receiving space, the drawers can be pulled out smoothly in any of the three directions.

What is claimed is:

1. A cabinet comprising:

a case having an opening in each end and in at least one side;

a drawer support member having a first surface, said drawer support member being mounted in said case so as to be slidable relative to said case in a first direction which is parallel to said first surface;

a drawer supported on said drawer support member so as to be slidable relative to said drawer support member in a second direction which is parallel to said first surface and perpendicular to said first direction, said drawer having a second surface which is parallel to and in juxtaposition with said first surface; and a pair of magnets having opposite polarities relative to each other, one of said magnets being mounted on said first surface and the other of said magnets being mounted on said second surface, wherein said magnets align with each other in a direction which is perpendicular to said first direction when said drawer is received completely in said drawer support member.

2. The cabinet as claimed in claim 1, wherein said drawer support member includes a positioning plate extending perpendicularly from said first surface, said cabinet further comprising:

a permanent magnet mounted on said positioning plate; and a metallic piece connected to said casing such that said metallic piece is attracted to said permanent magnet on said positioning plate when said drawer support member is completely inserted in said casing.

3. The cabinet as claimed in claim 1, wherein said magnets have annular or circular opposed surfaces.

4. The cabinet as claimed in 1, further comprising a first guide member for guiding movement of said drawer relative to said drawer support member and a second guide member for guiding movement of said drawer support member relative to said case.

5. The cabinet as claimed in 1, wherein said magnets are each disc-shaped and have the same diameter, and the central axes of said disc-shaped magnets coincide when said drawer is completely received in said drawer support member.

6. The cabinet as claimed in 1, wherein one of said magnets is rod-shaped, and the other of said magnets is ring-shaped such that when said magnets are aligned a longitudinal axis of said rod-shaped magnet coincides with a central axis of said ring-shaped magnet.

7. The cabinet as claimed in claim 1, further comprising a positioning means for positioning said drawer support member in said casing, wherein said positioning means is disposed between opposing surfaces of said drawer and said case.

* * * * *